US007142084B2

(12) United States Patent
Cheng

(10) Patent No.: US 7,142,084 B2
(45) Date of Patent: Nov. 28, 2006

(54) HIGH CURRENT INDUCTOR AND THE MANUFACTURING METHOD

(76) Inventor: Chang Mao Cheng, No. 1 Industrial Area, No. 4 Village, Shijie Town, Dongguan City, Guangdong Province (CN)

( * ) Notice: Subject to any disclaimer, the term of this patent is extended or adjusted under 35 U.S.C. 154(b) by 0 days.

(21) Appl. No.: 11/045,278

(22) Filed: Jan. 31, 2005

(65) Prior Publication Data

US 2006/0001517 A1 Jan. 5, 2006

(30) Foreign Application Priority Data

Jul. 2, 2004 (CN) ..... 2004 2 0074369

(51) Int. Cl.
*H01F 5/00* (2006.01)

(52) U.S. Cl. ..... 336/200

(58) Field of Classification Search ..... 336/65, 336/83, 192, 200, 232, 233
See application file for complete search history.

(56) References Cited

U.S. PATENT DOCUMENTS

| | | | | |
|---|---|---|---|---|
| 6,621,397 | B1 * | 9/2003 | Hsu | 336/96 |
| 6,791,445 | B1 * | 9/2004 | Shibata et al. | 336/90 |
| 6,940,387 | B1 * | 9/2005 | Shibata et al. | 336/200 |
| 2004/0145442 | A1 * | 7/2004 | Matsutani et al. | 336/200 |
| 2004/0189430 | A1 * | 9/2004 | Matsutani et al. | 336/83 |

* cited by examiner

*Primary Examiner*—Tuyen T Nguyen
(74) *Attorney, Agent, or Firm*—Rosenberg, Klein & Lee

(57) ABSTRACT

An inductor with the characteristic of resisting high current comprising a conductor coil and a magnet envelope, the magnet envelope tightly wraps the periphery of the conductor coil and forms the main body of the inductor, and the two extending parts of the conductor coil extend to outside of the main body of the inductor, forming terminal electrode. As of the manufacturing method, it includes the part of toroid coil and the extending parts composing the conductor coil. After the toroid coil part is winded into rings, the unwinded wire ends form the extending parts. Through magnet envelope die-casting and wrapping the molded magnet core of the conductor coil to form the main body of the inductor, and the extending parts of the conductor coil extend to outside of the main body to form the terminal electrode.

1 Claim, 8 Drawing Sheets

HIGH CURRENT INDUCTOR AND THE MANUFACTURING METHOD

FIELD OF THE INVENTION

The present invention relates to an inductor with the characteristic of resisting high current, and more particularly, to an inductor with a kind of magnet envelope tightly wrapping the periphery of the toroid coil of the conductor coil which enables the characteristic to resist high current. While the way to make the inductor is a kind of original method suitable for making surface mount design (SMD) inductor as well as plug-in inductor.

BACKGROUND OF THE INVENTION

In general, according to the manufacturing method to make common inductors, a frame with open side chamber should be made at first in which a conductor coil mounted with magnet core is mounted inside the chamber, the coil can move freely, finally stuffings or emissions are used to fix the conductor coil inside the chamber and the two conducting wire terminals are bended and covered outside the frame to form a inductor structure.

Although the conductor coil of the common inductor can be fixed inside the chamber of the frame through stuffings or emissions, because the conductor coil is not directly integrated with the frame, so the efficiency achieved by the inductor is greatly diminished.

Although some persons in the industry try to fix a conductor coil into a mould with supporting parts, then inject fusion magnet molding material into the mould, so that the conductor coil can be integrated with the magnet material. But, because the supporting parts must be dismantled and the second injection moulding must be carried out with the magnet molding material, so other than it will badly affect the manufacturing efficiency of the inductor, it there is any deviation of the positioning the conductor coil, the actual efficiency of the inductor will be badly affected too.

In addition, some persons in the industry try to put the thin paste containing magnet ceramic material in a mould by use of wet press treatment and make it a magnet mould, then mount the magnet mould into another mould, and fix a conductor coil inside the magnet mould body, at the same time inject the magnet material to make a magnet mould body through wet press treatment. Finally, by use of annealing, the magnet mould of the inductor solidifies as a complete inductor. However, because the production process involves paste injection and press mould of the thin paste magnet ceramic material, so other than badly affecting the manufacturing efficiency, Many uncertainties in the molding operation of mixing thin paste with conductor coil also affect the efficiency of the inductor.

SUMMARY OF THE INVENTION

The main purpose of the present Invention is to provide a kind of inductor with the characteristic of resisting high current, and with the structure of magnet envelope tightly wrapping the periphery of the conductor coil, the inductor can not only meet the requirements to accept higher current, but also achieve better saturation characteristic.

The secondary purpose of the present Invention is to provide a kind of inductor with the characteristic of resisting high current, with the structure of magnet envelope totally wrapping the conductor coil, so that gain an inductor without any air gap.

Another purpose of the invention is to provide kind of inductor with the characteristic of resisting high current, with the structure of magnet envelope totally wrapping the conductor coil, so that gain an inductor with closed magnet circuit structure.

The additional purpose of the invention is to provide a kind of inductor with the characteristic of resisting high current, with the structure of magnet envelope totally wrapping the conductor coil, so that gain an inductor in which the magnet envelope can easily form a tightly wrapping structure through die-casting.

The ultimate purpose of the invention is to provide a kind of inductor with the characteristic of resisting high current, with the structure of magnet envelope totally wrapping the conductor coil, which can replace the traditional E-shape or toroid coil inductor, and because the inductor have the advantage that use the conductor coil with less turns to meet the requirements for same inductance, so that can greatly improve the DCR performance of the inductor.

BRIEF DESCRIPTION OF THE DRAWINGS

The structure of the technology in the present invention will become more apparent by describing the preferred embodiments thereof in more details with reference to the accompanying drawings in which:

FIG. 3-K is the illustration showing the structure of surface mount inductor mounted to the circuit board;

FIGS. 4-B~4-K are illustrations showing the manufacturing process of plug-in inductor disclosed in the present invention;

FIG. 4-L is the illustration showing the structure of plug-in inductor mounted in the circuit board;

DESCRIPTIONS OF THE PREFERRED EMBODIMENTS

Figure 1A:
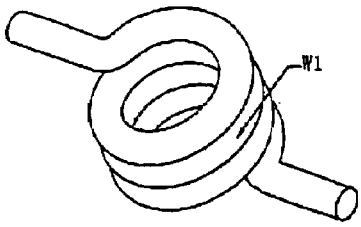
FIGS. 1-A~1-E are illustrations showing the pressing process of conductor coil.
Figure 1B:
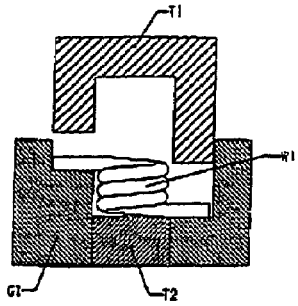
Figure 1C:
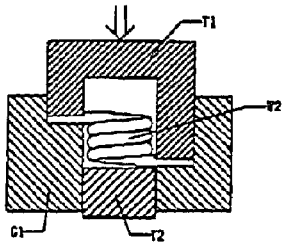
Figure 1D:
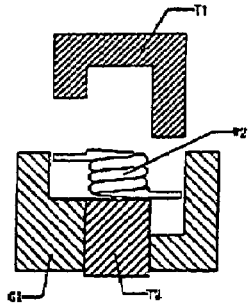
Figure 1E:
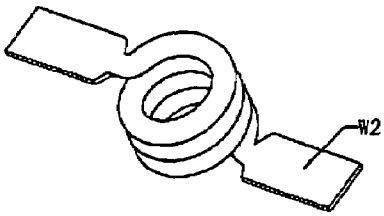
Figure 2A:
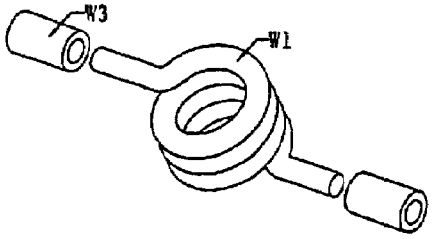
FIGS. 2-A~2-E are illustrations showing the pressing process of the two extending parts of the conductor coil after attaching hollow copper sheathing.
Figure 2B:
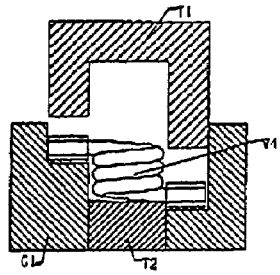
Figure 2C:
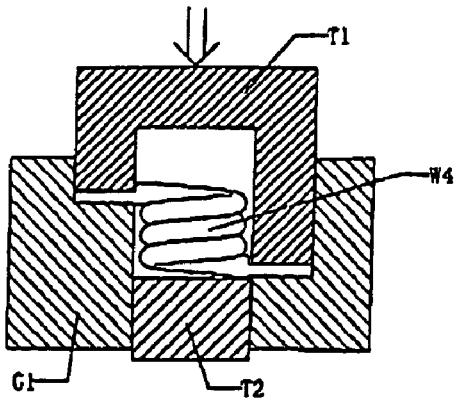
Figure 2D:
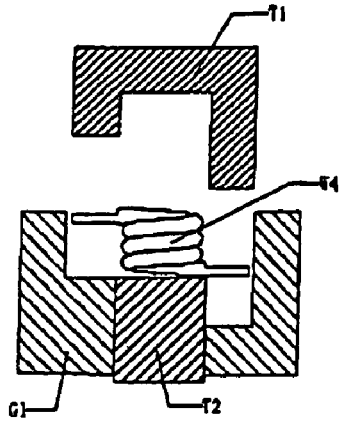
Figure 2E:
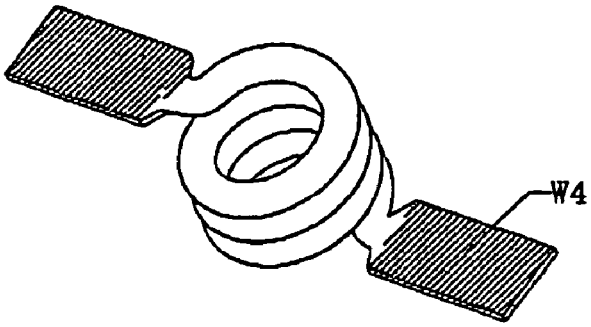
Figure 3A:
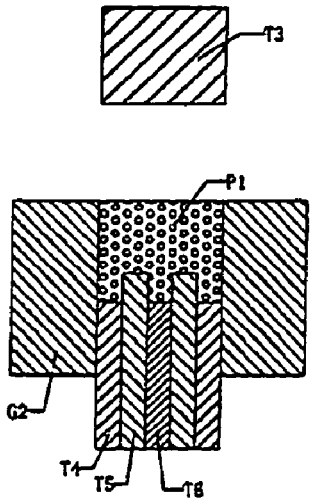
FIGS. 3-A~3-J are illustrations showing the manufacturing process of surface mount inductor disclosed in the present invention.
Figure 3B:
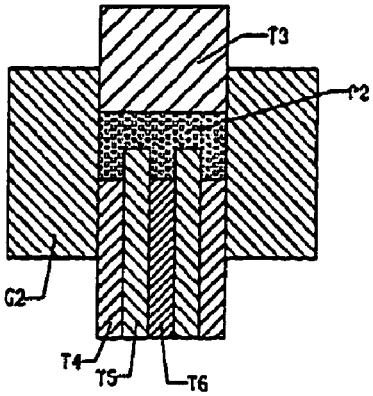
Figure 3C:
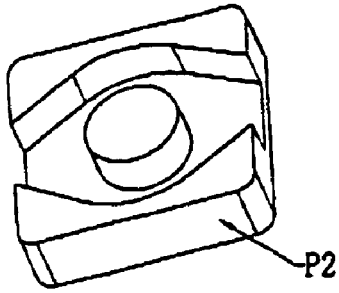
Figure 3D:
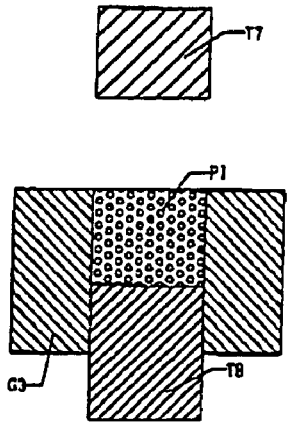
Figure 3E:
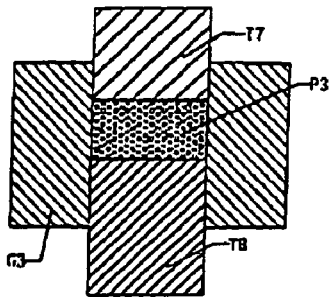
Figure 3F:
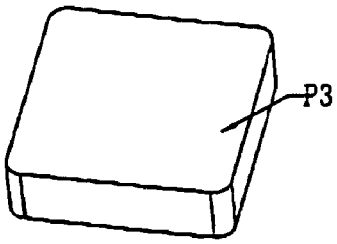
Figure 3G:
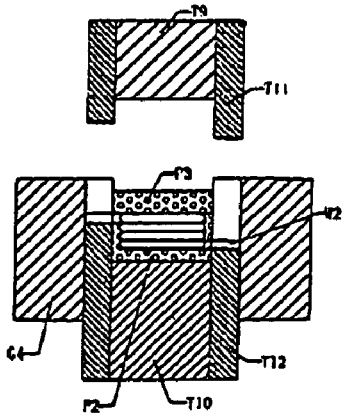
Figure 3H:
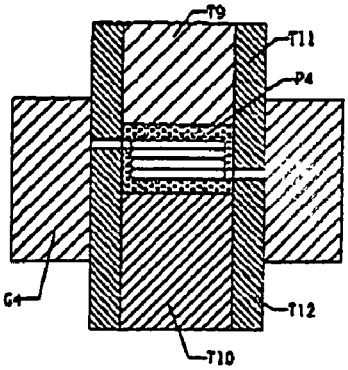
Figure 3I:
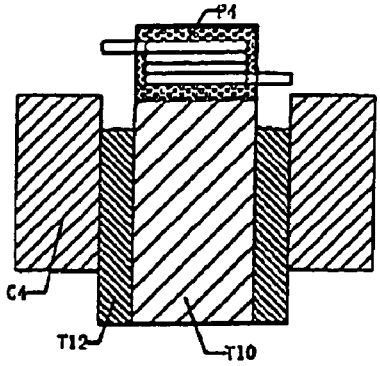
Figure 3J:
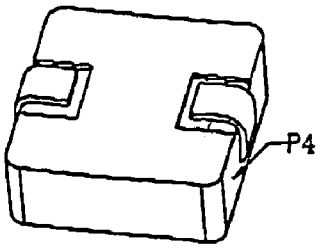
Figure 3K:
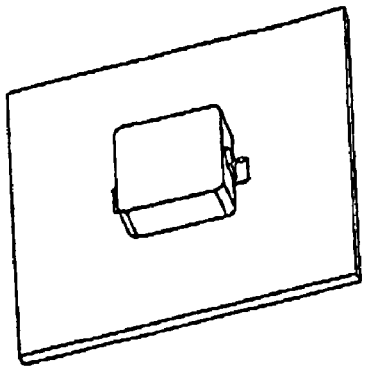
Figure 4A:
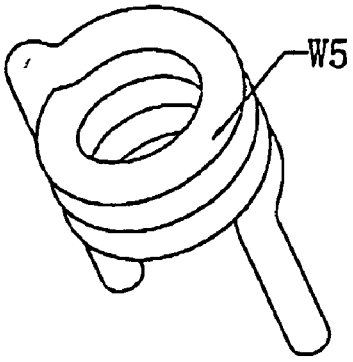
FIG. 4-A is the structure drawing of another example of conductor coil.
Figure 4B:
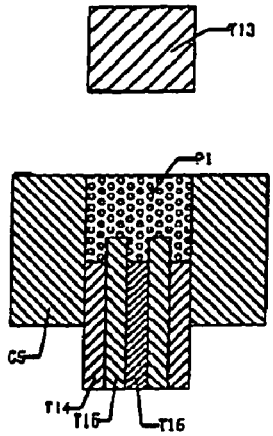
Figure 4C:
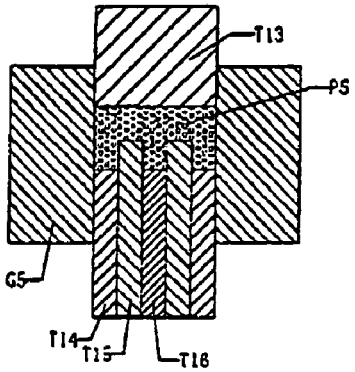
Figure 4D:
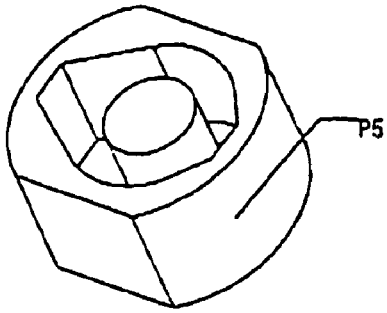
Figure 4E:
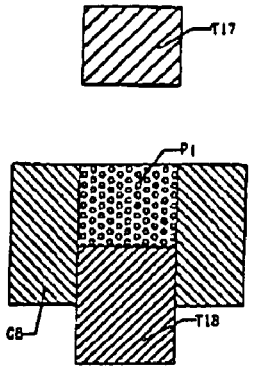
Figure 4F:
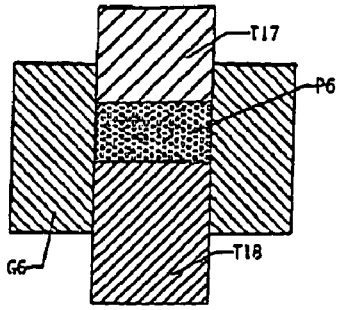
Figure 4G:
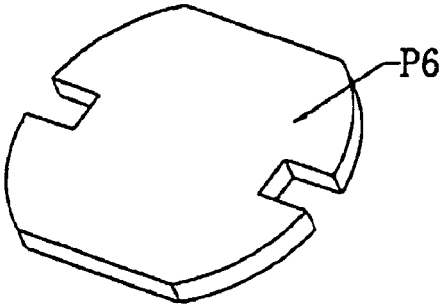
Figure 4H:
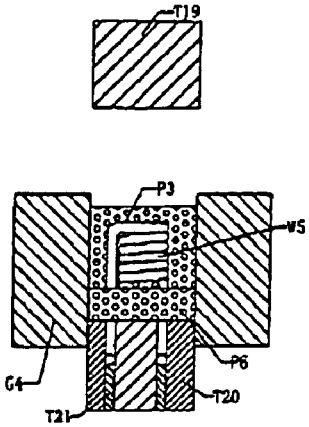
Figure 4I:
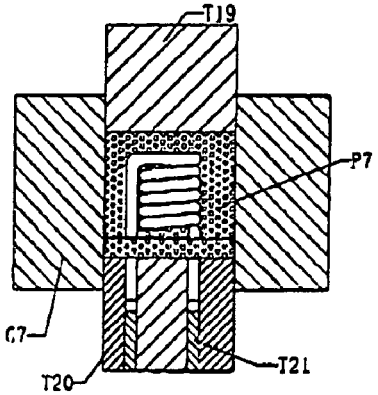
Figure 4J:
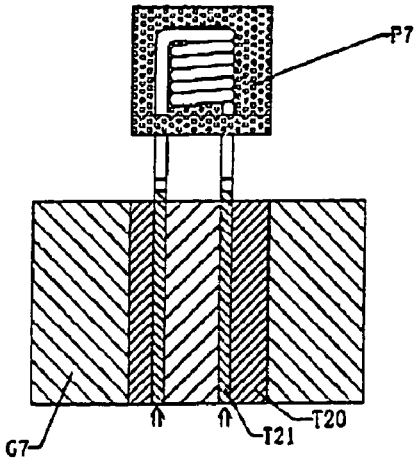
Figure 4K:
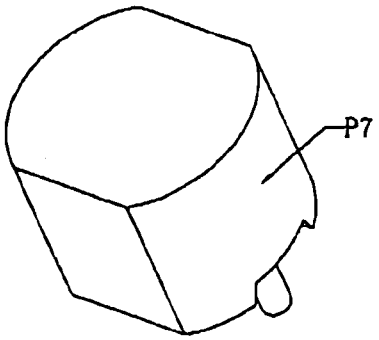
Figure 4L:
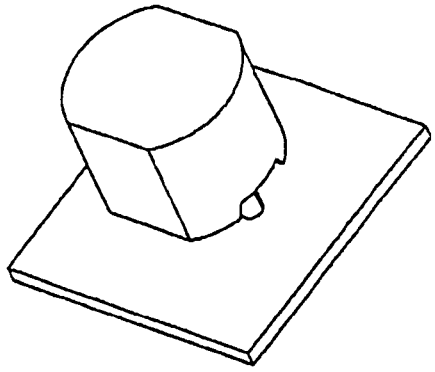

The inductor disclosed in the invention consists of a conductor coil and a magnet envelope which tightly wraps the periphery of the coil and form the main body of the inductor. In addition, the two extending parts of the conductor coil extend to outside of the magnet envelope to form terminal electrode.

The magnet envelope mainly consists of materials including three types of metal magnet powder (A magnet powder, B magnet powder and C magnet powder) plus insulation material (Polyester resin) X, Epoxy, Silicone and lubricant (Zinc Stearate), of which all of the three types of metal magnet powder mainly consist of carbonyl iron powder, and the difference is that the granule size of A magnet powder is 8 μm, and that of B magnet powder is 6 μm and C magnet powder is 4 μm.

Since the granule size of the three types of metal magnet powder are different, in principle, if the granules are larger, AL value is higher, core loss is larger and the application frequency is lower; contrarily, if the granules are smaller, AL value is lower, the core loss is smaller and the application frequency is higher. Therefore, by use of the above-mentioned property relationship, through proper adjustment of the blending proportion of the three types of metal magnet powder, the inductor made according to the invention will achieve the best electrical characteristic meeting the demands of market. Basically, the AL value of the inductor made according to the present invention will be 1.8 to 3.6 times higher than traditional inductors, and the property of resisting high current can be improved by about 10% to 30%.

The manufacturing method related to the present invention is to adjust the relevant proportion of the three types of magnet powder properly according to demands on the electrical characteristics, then add insulation material X and dilution (acetone) into the three types of magnet powder for insulation treatment. After fully and evenly stirring, the blended materials are put into the furnace (curing temperature: 60□–180□, curing time: 30 minutes–180 minutes), so that the insulation material can be hardende and form a layer of insulation film on the surface of the magnet powder.

Then, after adding Epoxy and silicone into the materials after insulation treatment, fully stir it into paste, then make use of granule-making machine to make larger granules (granule size ranges from 0.6 mm to 0.15 mm), so that enable the materials meet the requirement for needed fluidity at the time of molding. After that, put the materials after granule-making operation into furnace (roast temperature: 100□, roast time: 45 minutes), after completion of roasting, put the lubricant (Zinc Stearate) into the material and blend evenly, then the complete molding material P1 is made.

[Molding]

After that, fill the complete molding material (P1) into a permanent mould (example: G2) and enable the magnet envelope (example P2 and P3) of pre-compressed density ranging form 2.5 g/cm$^3$ to 4.0 g/cm$^3$, then put the pre-compressed magnet envelope and needed conductor coil (example: W2) into another permanent mould (compound mould) for die-casting operation, and enable the density of the magnet envelope reach 5.5 g/cm$^3$ to 4.0 g/cm$^3$, then form an inductor after die-casting.

[Annealing]

Finally, put the inductor after die-casting into a tunnel firing furnace (annealing temperature: 120□–200□, annealing time: 60 minutes), and make those materials added into the magnet envelope of the inductor namely epoxy, silicone and lubricant (Zinc Stearate) etc. reach the status of hot fusion and thermosetting, so that complete the whole manufacturing process of the inductor according to the invention.

In order that all the persons familiar with the technology fully understand the structure and technology of the invention, preferred embodiments of the manufacturing process of the present invention inductor will be described with reference to the accompanying drawings as the following:

1. Preparation of the Conductor Coil:

FIG. 1-A is the structure drawing of the prototype W1 of the conductor coil. Other than the prototype W1 is structured by the conducting wire of round section, its middle part forms toroid coils, in addition, the two ends of the toroid coil have extending part outside the toroid coil part respectively.

In preparing the conductor coil, at first put and fix the conductor coil prototype W1 into a permanent mould G1, as FIG. 1-B shows. Then, press the mobile mould T1 which is set above the mould G1, and make it move down and into the permanent mould G1 and then press the two extending parts of prototype W1 of the conductor coil, just as FIG. 1-C shows, enable the two extending parts turn from conducting wire with round section into flat shape, and then form a conductor coil W2. Then, press the mobile mould T2 under the permanent mould G1, make it move upward and push the conductor coil W2 away from the permanent mould G1, just as FIG. 1-D shows. And FIG. 1-E shows the structure drawing of conductor coil W2 after preparation.

In addition, in order to avoid the disadvantage of inadequate touching area between the two flat extending part pressed and the circuit board caused by the fact that the section of the conducting wires of the above-mentioned conductor coil is too small, the conductor coil can be prepared according to the following example. That is, wear the two extending parts of the prototype of the conductor coil with a hollow copper sheathing W3 respectively, just as FIG. 2-A shows. Then, put and fix the prototype W1 of the conductor coil with hollow copper sheathings W3 into the permanent mould G1, just as FIG. 2-B shows. As above described, when pressing on the mobile mould T1 and make it move down into the permanent mould G1, and press the hollow copper sheathings W3 set on the two extending parts of the prototype W1 of the conductor coil, the two extending parts with hollow copper sheathings W3 will be turned into flat shape to form a conductor coil W4, just as FIG. 2-C shows. Finally, exert pressure on the mobile mould T2, so that it moves upwards and push away the conductor coil W4 from the permanent mould G1, as is shown in FIG. 2-D, thereby finishing the preparation course of conductor coil W4. Please see FIG. 2-E for structure of conductor coil W4.

2. Preparation of Magnet Envelope:

Concerning preparation of magnet envelope, firstly, the above-mentioned powdery molding material P1 is filled in the permanent mould G2, as is shown in FIG. 3-A. And then, pressure is exerted on the mobile mould T3 which is located above the permanent mould G2, so that it moves downwards and enter the permanent mould G2, thereby exerting pressure on the powdery molding material P1. In this way, the magnet envelope P2 can be precast, as is shown in FIG. 3-B. As a result, while exerting pressure on the mobile moulds T4, T5 and T6 that are located under the permanent mould G2 respectively, the magnet envelope P2 will be pushed away from the permanent mould G2. Structure of the magnet envelope P2 is shown in FIG. 3-C, it has a conductor coil's containing groove whose both sides are open and in the center of which there is a cylinder.

In addition, fill the powdery molding material P1 in the permanent mould G3, as is shown in FIG. 3-D. Exert pressure on the mobile mould T7 located above the permanent mould G3, so that it moves downwards and enter the permanent mould G3, thereby exerting pressure on the powdery molding material P1 and thus another magnet envelope P2 can be precast, as is shown in FIG. 3-E. Afterwards, while exerting pressure on the mobile mould T8 under the permanent mould G3, the magnet envelope P3 will be pushed away from the permanent mould G3. Structure of the magnet envelope P3 is shown in FIG. 3-F.

3. Preparation of the Inductor:

Put magnet envelope P2, conductor coil W2 (or W4) and magnet envelope P3 into a permanent mould G4 in turn. The conductor coil W2 (or W4) is put in conductor coil's containing groove of magnet envelope P2, and the cylinder of conductor coil's containing groove is put in the center of circular coil of conductor coil W2 (or W4). In addition, two extending parts of conductor coil W2 (or W4) are fixed on the mobile mould T12 separately, as is shown in FIG. 3-G.

Afterwards, exert pressure on the mobile mould T9 above the permanent mould G4 to make it move downwards and enter the permanent mould G4, with that magnet envelope P2, conductor coil W2 (or W4) and magnet envelope P3 can be die-cast into an complete inductor P4, as is shown in FIG. 3-H. And then, exert pressure on the mobile mould T12 under the permanent mould G4 to make it move upwards to push away the inductor P4 from the permanent mould G4, as is shown in FIG. 3-I. Finally, wind two extending parts of conductor coil W2 (or W4) around the conductor P4 until the top of P4, thereby forming a complete surface mount design (SMD) inductor, as is shown in FIG. 3-J.

At this moment, put above-mentioned SMD inductor into a tunnel firing furnace (Annealing temperature: 120□~200□, Annealing time: 60 minutes), and then can finish the intact preparation course of this invention container, so far the intact preparation course of this invented inductor is finished.

The execution example to stick the above-mentioned SMD inductor on a circuit board is shown in FIG. 3-K.

The example of preparation course of another plug-in inductor is shown in FIGS. 4-A~4-L. Among them, the conductor coil W5 has a circular coil whose two extending parts present the structure of extending in the same direction, and besides, these two extending parts present the structure of round section not flattened.

With regard to its preparation, firstly, the powdery molding material P1 is filled in the permanent mould G5, as is shown in FIG. 4-B, afterwards exert pressure on the mobile mould T13 above the permanent mould G5 to make it move downwards and enter the permanent mould G5, thereby exerting pressure on the powdery molding material P1. In this way, the magnet envelope P5 can be precast, as shown in FIG. 4-C. Structure of the magnet envelope P5 is shown in FIG. 4-D, P5 has a conductor coil's containing groove, in the center of which there is a cylinder.

In addition, fill the powdery molding material P1 in the permanent mould G6, as is shown in FIG. 4-E. Exert pressure on the mobile mould T17 located above the permanent mould G6, so that it moves downwards and enter the permanent mould G6, thereby exerting pressure on the powdery molding material P1 and thus another magnet envelope P6 can be precast, as shown in FIG. 4-F. Structure of the magnet envelope P6 is shown in FIG. 4-G, of which there are two holes for the two extending parts of the conductor coil W5 to get through.

Then the magnet envelope P6, the conductor coil W5 and the magnet envelope P5 are placed into a permanent mould G7 in proper order, with two extending parts of the conductor coil W5 fixed on a mobile mould T21, illustrated as FIG. 4-H. Press a mobile mould T19 which is on the permanent mould G7, to make it move downwards and enter the permanent mould G7, thereby putting pressure on the magnet envelope P5, the conductor coil W5 and the magnet envelope P6, the production of the plug-in inductor P7 is thus completed. Then press another mobile mould T21 which is under the permanent mould G7, and make it move upwards to push the Plug-in inductor P7 off the permanent mould G7, illustrated as FIG. 4-J.

Finally, as described above, put the die-cast plug-in inductor P7 in a tunnel firing furnace (Annealing temperature: 120□~200□, Annealing time: 60 minutes), then an plug-in inductor is finished, illustrated as FIG. 4-K. FIG. 4-L shows such an plug-in inductor stuck into a circuit board.

Figure 5A:
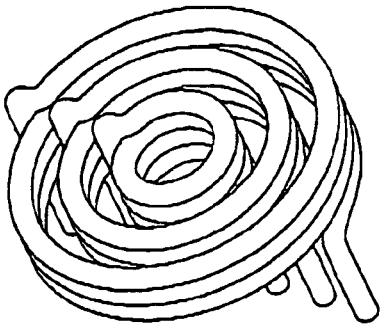
FIGS. 5-A~5-C are illustrations showing the manufacturing process of plug-in inductor with multiple conductor coils disclosed in the present invention.
Figure 5B:
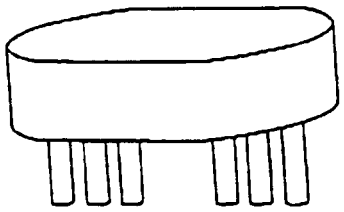
Figure 5C:
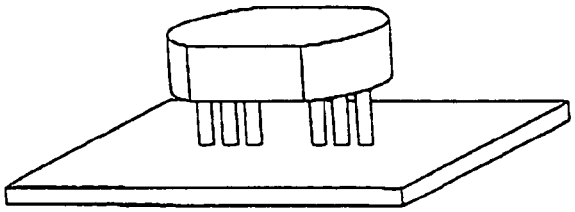

The structure of an plug-in inductor based on this invention with multiple conductor coils is illustrated in FIGS. 5-A~5-C. FIG. 5-A shows three conductor coils arranged in concentric circles, and FIG. 5-C that plug-in inductor fixed on a circuit board.

Figure 6A:
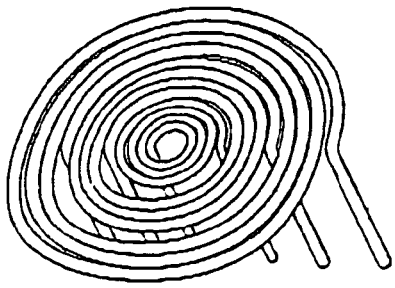
FIGS. 6-A~6-C are illustrations showing the manufacturing process of another plug-in inductor with multiple conductor coils disclosed in the present invention.
Figure 6B:
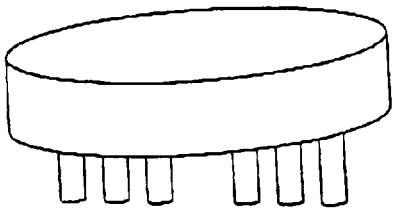
Figure 6C:
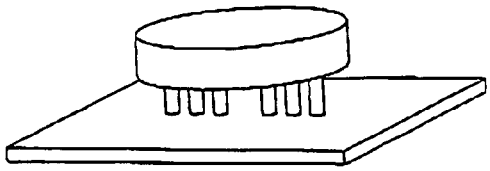

FIGS. 6-A~6-C illustrate the structure of another plug-in inductor with multiple conductor coils.

Figure 7A:
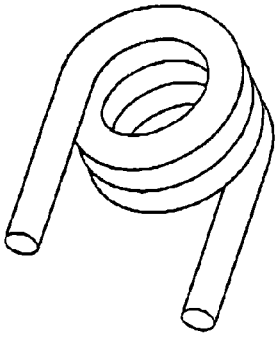
FIGS. 7-A~7-C are illustrations showing the manufacturing process of another plug-in inductor with single conductor coil disclosed in the present invention.
Figure 7B:
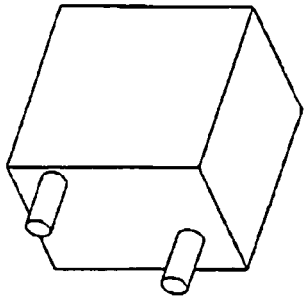
Figure 7C:
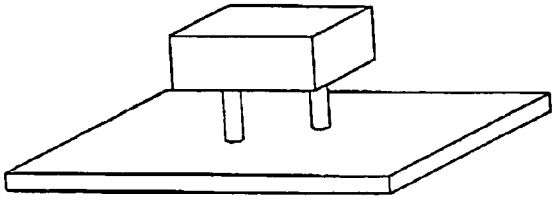

FIGS. 7-A~7-C illustrate the structure of an plug-in inductor with single conductor coil.

Figure 8A:
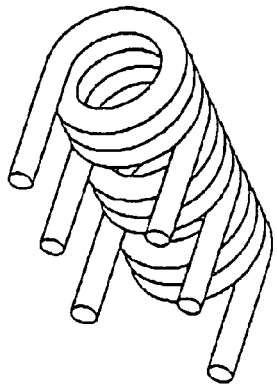
FIGS. 8-A~8-C are illustrations showing the manufacturing process of another plug-in inductor with multiple conductor coil disclosed in the present invention.
Figure 8B:
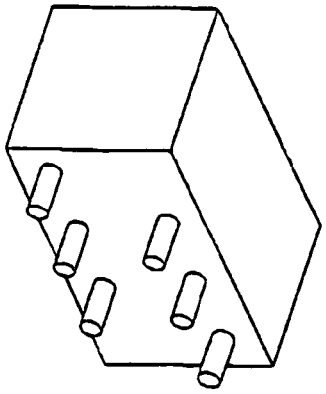
Figure 8C:
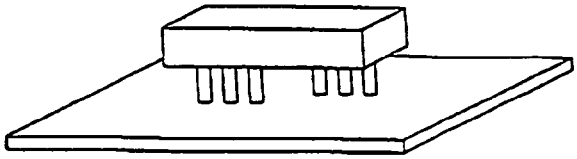

FIGS. 8-A~8-C show the structure of an plug-in inductor with several conductor coils as FIG. 7-A arranged in series.

In terms of descriptions above, we can naturally find the Inductor's following features:

1. Totally different in structure with traditional E-inductors or toroid inductors whose magnetic cores and conductor coils are not sealed, the Inductor has conductor coil(s) completely wrapped by magnet envelope, so a closed magnet circuit structure is formed and the magnetic lines of force are confined within an area just around the magnet envelope. As a result, the inductor is especially applicable to high density circuit boards.
2. Because the Inductor is completely filled with magnetic materials, the magnet space is made best use of. So it is smaller than traditional inductors in volume.
3. Because the Inductor is completely filled with magnetic materials, it can reach the same inductance with less turns of conductor coils. So its DCR performance is better than that of traditional inductors, about 10~30% lower.
4. Both ends of the conductor coils form two welding ends naturally through press process or hollow copper sheathing jointing press process, so the inductor has much simpler conduct coil terminals, and the cost is thus lowered.
5. According to this invention, the production process of the Surface Mount Design (SMD) Inductor can be used for the Plug-in inductor as well, so the Inductor has a wider range of application.
6. The Inductor is made of high-impedance magnetic materials (above 100 MΩunder 100 V), so the generation of induction path does not occur in surface mount circuits, and this makes the Inductor work effectively under a frequency as high as 100 MHz.
7. The integrated structure of the Inductor greatly saves manpower of binding coils around magnets needed for traditional coil-inductors.

The detailed techniques of this invention are clarified with the aid of several given examples in above descriptions, however, these examples should not be regarded as the limits this invention prescribes; in other words, any amendments to this invention by persons who are familiar with these techniques, if not separated from the essence and norms of this invention, shall still fall within the protection scope of this invention's patent right.

What is claimed is:

1. A high current inductor, comprising:

a conductor coil, said conductor coil including a toroid coil of a substantially circularly contoured cross-section, two extending parts of the toroid coil extending in the opposite directions of the toroid coil, and a pair of hollow copper sheathings, each placed on a respective one of said two extending parts in surrounding relationship with said substantially circularly contoured cross-section thereof, said each hollow copper sheathing and said respective extending part forming together a substantially flat extending portion of said high current inductor, said flat extending portion being formed by simultaneous pressing of said two extending parts and said pair of hollow copper sheathings placed respectively over said two extending parts; and a magnet envelope wrapping around a periphery of said conductor coil, said magnet envelope being formed from powdery moulding materials and fixed at the periphery of the toroid coil of the conductor coil through die-casting, said two extending portions of said conductor coil extending beyond said magnet envelope and being bent to extend along walls of said magnet envelope, thereby forming a Surface Mount Design (SMD) inductor.

* * * * *